US007966783B2

(12) United States Patent
Wilson et al.

(10) Patent No.: US 7,966,783 B2
(45) Date of Patent: Jun. 28, 2011

(54) CLADDING

(75) Inventors: Martyn Wilson, London (GB); David Browne, Redhill (GB); Michael Crossley, Horsham (GB)

(73) Assignee: BAA (IP HOLDCO) Limited, London (GB)

( * ) Notice: Subject to any disclaimer, the term of this patent is extended or adjusted under 35 U.S.C. 154(b) by 743 days.

(21) Appl. No.: 11/569,961

(22) PCT Filed: Jun. 3, 2005

(86) PCT No.: PCT/GB2005/002187

§ 371 (c)(1),
(2), (4) Date: Jun. 8, 2007

(87) PCT Pub. No.: WO2005/118977

PCT Pub. Date: Dec. 15, 2005

(65) Prior Publication Data

US 2008/0010927 A1 Jan. 17, 2008

(30) Foreign Application Priority Data

Jun. 4, 2004 (GB) ..... 0412524.1

(51) Int. Cl.
*E04H 1/00* (2006.01)
*E04F 13/08* (2006.01)

(52) U.S. Cl. ..... 52/235; 52/387; 52/388

(58) Field of Classification Search ..... 52/235, 52/387, 388

See application file for complete search history.

(56) References Cited

U.S. PATENT DOCUMENTS

| | | | | | |
|---|---|---|---|---|---|
| 3,204,380 | A | * | 9/1965 | Wilson et al. | 52/309.15 |
| 3,385,743 | A | | 5/1968 | Blackberg | |
| 3,397,496 | A | * | 8/1968 | Sohns | 52/286 |
| 4,299,069 | A | * | 11/1981 | Neumann | 52/309.4 |
| 4,486,491 | A | | 12/1984 | Kerekes et al. | |
| 4,833,855 | A | | 5/1989 | Winter | |
| 4,984,406 | A | | 1/1991 | Friesen | |
| 4,991,373 | A | * | 2/1991 | Shaub | 52/715 |
| 5,155,958 | A | | 10/1992 | Huff et al. | |

(Continued)

FOREIGN PATENT DOCUMENTS

CA 2 225 952 A1 6/1999

(Continued)

OTHER PUBLICATIONS

MICAM LSM21; Material Safety Data Sheet.

(Continued)

*Primary Examiner* — Richard E Chilcot
*Assistant Examiner* — Mark R Wendell
(74) *Attorney, Agent, or Firm* — Christopher L. Parmelee; Walker & Jocke

(57) ABSTRACT

There can be provided a method of cladding a surface with panelling. The method can comprise: attaching a first panel support member to the surface, the first panel support member being configured to receive at least a part of a first edge of a panel comprising a core of woven and non-woven glass impregnated with resin and a surface finish of paper and melamine resin; placing the first edge in a position of co-operative reception with the first panel support member; and placing a second edge of the panel substantially opposite the first edge in a position of co-operative reception with a second panel support member, the second panel support member being configured to be attached to the surface.

28 Claims, 5 Drawing Sheets

U.S. PATENT DOCUMENTS

| | | | | |
|---|---|---|---|---|
| 5,433,053 | A * | 7/1995 | Tulloch | 52/582.1 |
| 6,199,337 | B1 * | 3/2001 | Colson et al. | 52/506.06 |
| 6,311,441 | B1 | 11/2001 | Beavers et al. | |
| 7,096,629 | B1 * | 8/2006 | Cox | 52/235 |
| 2004/0074177 | A1 | 4/2004 | Berman | |
| 2006/0254178 | A1 * | 11/2006 | Swiszcz et al. | 52/506.06 |
| 2006/0254179 | A1 * | 11/2006 | Swiszcz et al. | 52/506.06 |
| 2006/0254204 | A1 * | 11/2006 | Swiszcz et al. | 52/793.1 |
| 2006/0254205 | A1 * | 11/2006 | Swiszcz et al. | 52/793.1 |
| 2006/0254206 | A1 * | 11/2006 | Swiszcz et al. | 52/793.1 |
| 2006/0260269 | A1 * | 11/2006 | Swiszcz et al. | 52/783.1 |
| 2006/0260270 | A1 * | 11/2006 | Swiszcz et al. | 52/783.1 |
| 2006/0260271 | A1 * | 11/2006 | Swiszcz et al. | 52/783.1 |
| 2006/0260272 | A1 * | 11/2006 | Swiszcz et al. | 52/783.1 |

FOREIGN PATENT DOCUMENTS

| | | | |
|---|---|---|---|
| FR | 2122075 | A | 8/1972 |
| FR | 2649643 | A1 | 1/1991 |
| GB | 941437 | A | 11/1963 |
| GB | 1 471 485 | A | 4/1977 |
| GB | 1568232 | A | 5/1980 |
| GB | 2168732 | A | 6/1986 |
| GB | 2344360 | A | 6/2000 |
| JP | 47-020931 | A | 10/1972 |
| JP | 51-137907 | U | 11/1976 |
| JP | 55-160439 | U | 11/1980 |
| JP | 58220730 | A | 12/1983 |
| JP | 61-137956 | A | 6/1986 |
| JP | 12064977 | A | 10/1989 |
| JP | 08-302957 | A | 11/1996 |
| JP | 08302957 | A1 | 11/1996 |
| JP | 09-125673 | A | 5/1997 |
| JP | 10-305526 | A | 11/1998 |
| JP | 2002240228 | A | 8/2002 |
| JP | 2003247317 | A | 9/2003 |
| WO | 88/01326 | A1 | 2/1988 |

OTHER PUBLICATIONS

MICAM EM42; Material Safety Data Sheet.

MICAM LSM21; Material Safety Data Sheet; Available from: www.MICAM.com; Print date: Jun. 10, 2004.

MICAM EM42; Material Safety Data Sheet; Available from: www.MICAM.com; Print date: Jun. 10, 2004.

GB Search Report for Priority Application GB0412524.1; Sep. 28, 2005.

Examination Report; Patent Application No. 2007-514131 submitted Feb. 14, 2011.

* cited by examiner

CLADDING

The present invention relates to panels, and in particular but not exclusively to surface cladding and a surface cladding system for use in areas where a high fire resistance, low smoke emissions, low toxicity under heating, low fire loading under heating, low spread of flame, high wear and abrasion resistance, and/or high impact resistance are required.

INTRODUCTION

There are in existence minimum safety standards for buildings, especially those associated with public services where large numbers of members of the public are expected to pass through. Such buildings include airports, railway stations, underground railway stations and bus stations. All of these buildings are associated with large numbers of persons moving between separate areas and the movement of public transportation vehicles. Examples of other buildings where safety standards may be strict include cinemas and theatres, where large numbers of persons are grouped together in a relatively small space. The safety standards which can apply to such buildings include not only those associated with the safe construction of the building, but also those associated with the interior fixtures and fittings of the building. The safety standards can include regulations setting out fire resistance requirements for such fixtures and fittings, and toxicity of emissions resulting from heating in a fire situation for such fixtures and fittings.

SUMMARY OF THE INVENTION

The present invention has been made, at least in parts, in consideration of problems and drawbacks of conventional systems.

Viewed from a first aspect, the present invention provides a method of cladding a surface with panelling. The method can comprise: attaching a first panel support member to the surface, the first panel support member being configured to receive at least a part of a first edge of the panel; attaching a second panel support member to the surface, the second panel support member being configured to receive at least a part of a second edge of the panel substantially opposite the first edge; placing the first edge in a position of co-operative reception with the first panel support member; flexing the panel to enable the second edge to be placed in a position of co-operative reception with the second panel support member; and de-flexing the panel such that the panel is supported by the first and second support members. The panel comprises a core of woven and non-woven glass impregnated with resin and a surface finish of paper and melamine resin. This method provides for a quick and easy to fit panelling system offering robustness and tamper-resistance. The panel can be fire resistant to provide additional safety to users of the environment in which the panel is fitted.

Viewed from a second aspect, the present invention provides a panelling system. The system can comprise comprising: a panel for cladding a wall, the panel comprising a core of woven and non-woven glass impregnated with resin and a surface finish of paper, foil or other fire rated material and melamine resin; a first edge support member for supporting a first edge of the panel in position adjacent the wall; and a second edge support member for supporting a second edge of the panel in a position adjacent the wall. The panel can be configured to be flexed to be fitted to pre-installed lower and upper edge support members. This system provides a quick and easy to fit panelling system offering robustness and tamper-resistance. The panel can be fire resistant to provide additional safety to users of the environment in which the panel is fitted.

Viewed from a third aspect, the present invention provides a wall panel for use in cladding a wall, the panel comprising a core of woven and non-woven glass impregnated with resin and a surface finish of paper and melamine resin. This wall panel provides a high level of fire safety for users of an environment in which the panel is installed. Thus spread of fire and emission of toxic fumes during a fire can be limited to increase safety.

Viewed from a fourth aspect, the present invention provides the use of a composite material having core of woven and non-woven glass impregnated with resin and a surface finish of paper and melamine resin in an architectural surface cladding panel. This arrangement provides a panel having high fire safety performance, increasing the safety of an environment in which the panel is installed.

Viewed from a fifth aspect, the present invention provides a wall system. The wall system can comprise a number of panels, each having a plurality of male interface members and a plurality of female interface members. The panels can be arranged to form a wall or partition, separate panels being joined together by co-operative interfacing of respective male and female interface members of the panels.

Viewed from a sixth aspect, the invention provides a system for cladding a curved surface. The system can include a plurality of thin panels, each sufficiently flexible to bend to the curvature of the surface, the panels being configured to be affixed to one-another to form a multi-layer composite panel to clad the curved surface.

Viewed from a seventh aspect, the invention provides a system for overcladding an existing surface cladding arrangement. The system can include a thin overcladding panel for attachment to the existing surface cladding arrangement.

Viewed another aspect, the present invention provides a method of cladding a surface with panelling. The method can comprise: attaching a first panel support member to the surface, the first panel support member being configured to receive at least a part of a first edge of the panel; and placing the first edge in a position of co-operative reception with the first panel support member. The method can also comprise: aligning a second panel support member with at least a part of a second edge of the panel substantially opposite the first edge; attaching the second panel support member to the surface, such that following fixing the second panel support member the panel is supported by the first and second support members. The panel can comprise a core of woven and non-woven glass impregnated with resin and a surface finish of paper and melamine resin. This method provides for a quick and easy to fit panelling system offering robustness and tamper-resistance. The panel can be fire resistant to provide additional safety to users of the environment in which the panel is fitted.

Viewed from a further aspect, the invention can provide a method of cladding a surface with panelling. The method can comprise: attaching a first panel support member to the surface, the first panel support member being configured to receive at least a part of a first edge of a panel comprising a core of woven and non-woven glass impregnated with resin and a surface finish of paper and melamine resin; and placing the first edge in a position of co-operative reception with the first panel support member. The method can also comprise placing a second edge of the panel substantially opposite the first edge in a position of co-operative reception with a second panel support member, the second panel support member being configured to be attached to the surface. This method provides for a quick and easy to fit panelling system offering robustness and tamper-resistance. The panel can be fire resistant to provide additional safety to users of the environment in which the panel is fitted.

Particular and preferred aspects and embodiments of the invention are set out in the appended independent and dependent claims.

BRIEF DESCRIPTION OF FIGURES

Specific embodiments of the present invention will now be described by way of example only with reference to the accompanying figures in which.

Figure 4B:
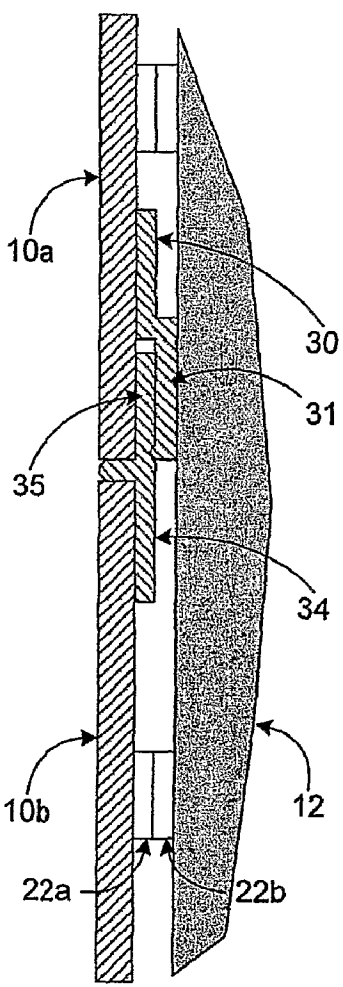
FIGS. 4*a* and 4*b* show a schematic representation of a system for fixing two surface cladding panels together.

While the invention is susceptible to various modifications and alternative forms, specific embodiments are shown by way of example in the drawings and are herein described in detail. It should be understood, however, that drawings and detailed description thereto are not intended to limit the invention to the particular form disclosed, but on the contrary, the invention is to cover all modifications, equivalents and alternatives falling within the spirit and scope of the present invention as defined by the appended claims.

DESCRIPTION OF SPECIFIC EMBODIMENTS

For the construction and interior fit-out of certain buildings, such as airports and other public transport stations and interchanges, strict fire safety regulations can apply. For example, in the United Kingdom, the England and Wales Building Regulations specify a number of standards for construction and finishing of buildings. The most stringent such class in Class 0. In respect of fire safety, Class 0 can be satisfied in a number of ways, however the most common way to satisfy the requirements is through the meeting of two separate criteria. The first criterion is the achievement of Class 1 under BS 476-7, and the second is the achievement of $i1<6$ and $I<12$ under BS 476-6.

British Standard BS 476-7 classifies spread of flame characteristics for materials. The best level which a material can be classified to is Class 1. A material meeting the requirements to be classified to Class 1 exhibits a slow rate of flame spread across the material.

British Standard BS 476-6 sets out indicia against which rate of heat emissions can be measured. This comprises a measure of rate of emissions caused by heating and a measure of heat generated by the material when burning ("fire load"). The standard provides three subindicia i1, i2 and i3 as well as a summation index I.

The England and Wales Building Regulations allow a material to be designated as Class 0 if both of the criteria mentioned above are met. Taking the example of an airport, within the UK, Class 0 materials are required for the internal cladding of all passenger and most staff areas of the buildings.

Full copies of the England and Wales Building Regulations can be obtained from Her Majesty's Stationary office (HMSO), www.hmso.gov.uk. The regulations currently in force are set out in the Building Regulations 2000 (Statutory Instrument 2000 No 2531). Full copies of the British Standards BS 476-7 and BS 476-6 can be obtained from the BSi (formerly the British Standards Institute), www.bsi-global-.com. It is understood that similar regulatory requirements are applied to both public and private buildings, including airports, throughout the world.

As will be appreciated, in addition to meeting the requirements of building regulations, wall cladding for an airport or similar public place is desirably highly impact and abrasion resistant, resistant to graffiti (whether painted on or inscribed) and easy to clean. Additionally, an ability to provide visible images or text on the cladding may also be desirable.

An example of a surface cladding system for use in environments where a high level of fire safety is required will now be described. The system of the present example provides an easy to fit, high performance surface cladding arrangement.

In the surface cladding system of the present example, a panel can be formed from a combination of woven and non-woven glass impregnated with resin as a core with a paper/melamine surface resin. In one example, the panel can be formed from a material produced and sold by Micam Limited under the designation LSM21. Another such material is produced and sold by Micam Limited under the designation EM42. The skilled reader will appreciate that a number of suitable materials can exist and will recognise their suitability for use in a system such as that described in the present example. The use of such a panel material provides Class 0 performance at a significantly lower cost than conventional laminate panel systems, when installed as a system. In addition the material is graffiti resistant, and easy to clean, requiring no specialist cleaning materials for ordinary cleaning. The panels are also environmentally friendly in that they can be safely removed intact and can therefore be reused in other surface cladding applications. The panels can be finished and have full fire resistant properties on both sides, providing equal performance to both sides of the panel. Such panels are also impervious to water and dampness. The material is also impact resistant and has so-called "safe-break" properties such that sharp edges tend not to occur at breaking and there is a reduced tendency for explosive shattering causing material to be distributed over a wide area. The impact resistance of the material is such that no additional protective trolley rail is required in regions where luggage trolley or similar impact is possible, offering further cost savings over conventional panels.

The material of the present example is also suitable for over-cladding with text and/or images to facilitate the provision of advertising, decorative or informative material without a requirement for dedicated display units. The material of the present example can be over-clad using a back printed fire retardant polycarbonate adhered with transfer tape adhesive. This, in effect is a thin laminate having a "peel-and-stick" type backing, which can have any colour or graphic embedded into the laminate. An example of a suitable material for providing this function is manufactured by Novograf Limited under the designation Lamigraf™ C28/SM. By the use of such an over-cladding material, the Class 0 properties of the panel material are not compromised.

The panelling system of the present example uses a range of fixing elements to attach the cladding to a substrate material, usually a wall. The use of such fixing elements will now be described with reference to FIGS. 1 to 6.

Figure 1:
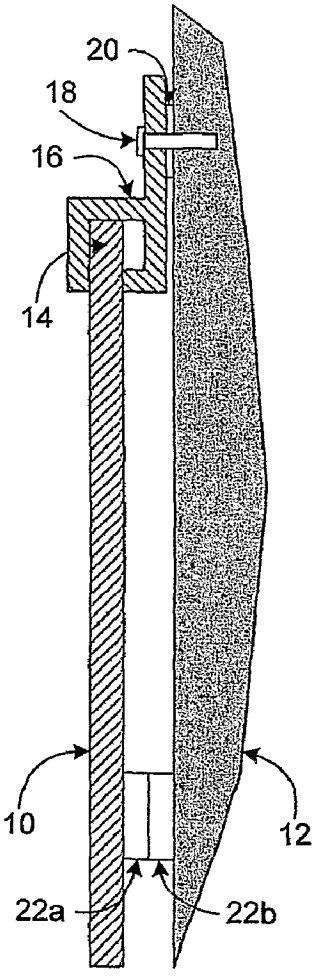
FIG. 1 is a schematic representation of a system for fixing a surface cladding panel to a wall at a top portion of the panel.

FIG. 1 is a schematic sectional view through a part of a panel 10. The Figure shows a horizontal view onto a plane running vertically up the panel and normal to the panel and a wall on which the panel is mounted.

The panel 10 is mounted onto a wall 12 and has an upper edge 14 which is restrained by an upper edge fixing member 16. The upper edge fixing member 16 has a generally U-shaped portion for receiving at least a part of the upper edge of the panel 10 and a longitudinal portion for affixment to the wall 12. In some examples the U-shaped portion can be C-shaped or G-shaped. The upper edge fixing member 16 is attached to the wall 12 by a fixing element 18 such as a bolt, screw or nail. A spacer 20 may be provided to distance the upper edge fixing member 16 from the wall 12. The fixing member 18 may be used in conjunction with an auxiliary fixing member (not shown) such as a captive nut or a wall plug.

Thus the upper edge of the panel 10 is restrained by the upper edge fixing member 16 and is prevented thereby from moving upwards, away from the wall or toward the wall. Additionally, primary restraint members 22*a* and 22*b* can be provided to hold the panel in position relative to the wall 12. In the present example, the primary restraint members 22*a* and 22*b* are a two-part interlocking mushroom head type fastening, with one part, 22*a*, being attached to the panel 10 and the other part, 22*b*, being attached to the wall 12. The primary restraint members 22*a* and 22*b* can be secured to the panel 10 and the wall 12 respectively using an adhesive. The use of the two-part interlocking head type primary restraint members provide a secure restraint against dynamic loading and eliminate rattle between the panel and wall. The fixing member 16 (and other fixing members described below) provide alignment guides for fitting of the panel and act as secondary restraint members to secure the panel to the wall in the case of failure of the primary restraint members, for example in the case of fire melting the primary restraint members.

Figure 2:
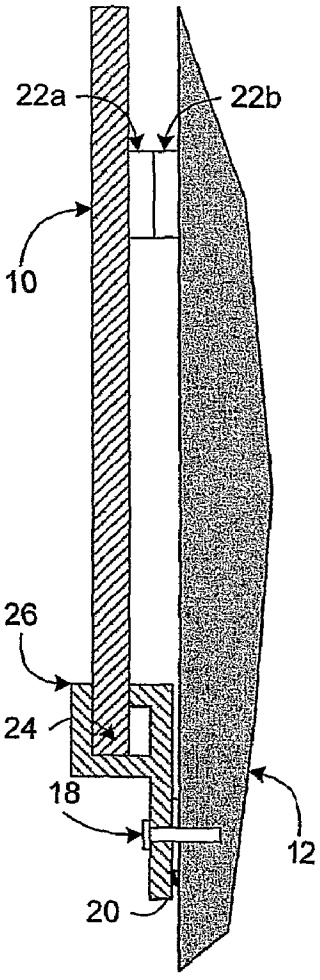
FIG. 2 is a schematic representation of a system for fixing a surface cladding panel to a wall at a bottom portion of the panel.

FIG. 2 is a schematic sectional view through a part of a panel 10. The Figure shows a horizontal view onto a plane running vertically up the panel and normal to the panel and a wall on which the panel is mounted.

The panel 10 of the present example has a lower edge 24 which can be restrained by a lower edge fixing member 26. The lower fixing member can have a generally U-shaped portion for receiving at least a part of the lower edge of the panel 10 and a longitudinal portion for affixment to the wall 12. In some examples the U-shaped portion can be C-shaped or G-shaped. The lower edge fixing member 26 is attached to the wall 12 by a fixing element 18 such as a bolt, screw or nail. A spacer 20 may be provided to distance the lower edge fixing member 26 from the wall 12. The fixing element 18 may be used in conjunction with an auxiliary fixing member (not shown) such as a captive nut or a wall plug.

Thus the lower edge of the panel 10 is restrained by the lower edge fixing member 26 and is prevented thereby from moving downwards, away from the wall or toward the wall. Additionally, primary restraint members 22*a* and 22*b* can again be provided to hold the panel in position relative to the wall 12.

Figure 3:
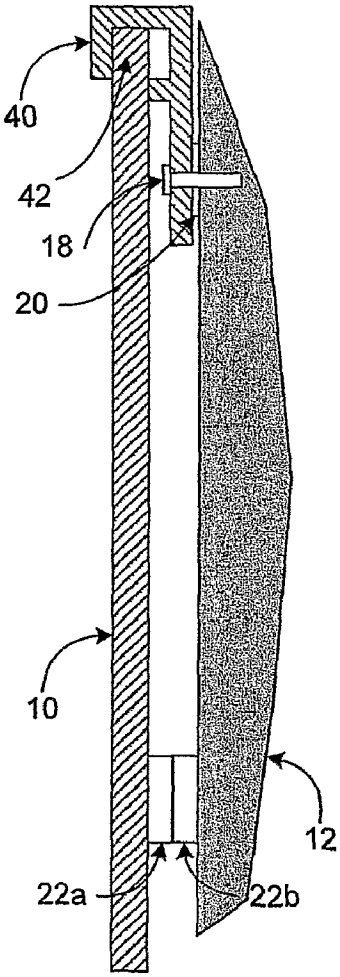
FIG. 3 is a schematic representation of a system for fixing a surface cladding panel to a wall at side portion of the panel.

FIG. 3 is a schematic sectional view through a part of a panel 10. The Figure shows a vertical view onto a plane running horizontally across the panel and normal to the panel and a wall on which the panel is mounted.

The panel 10 of the present example also has a side edge 42 which can be restrained by a side edge fixing member 40. The side edge fixing member can have a generally U-shaped portion for receiving at least a part of the side edge of the panel 10 and a longitudinal portion for affixment to the wall 12. In some examples the U-shaped portion can be C-shaped or G-shaped. The edge fixing member or stop end 40 is attached to the wall 12 by a fixing element 18 such as a bolt, screw or nail. A spacer 20 may be provided to distance the side edge fixing member 40 from the wall 12. The fixing element 18 may be used in conjunction with an auxiliary fixing member (not shown) such as a captive nut or a wall plug.

Thus the side edge of the panel 10 is restrained by the side edge fixing member 40 and is prevented thereby from moving horizontally in a direction through the side edge fixing member, away from the wall or toward the wall. Additionally, primary restraint members 22*a* and 22*b* are provided to hold the panel in position relative to the wall 12.

Thus there has now been described suitable fixing arrangements for securing a single panel to a wall. In order to fix such a panel to a wall using the fixing members, each fixing member is secure to the wall in advance of attaching the panel. Once all of the fixing members are attached to the wall, the panel can be fitted as follows: the lower edge of the panel can be placed into the lower edge fixing member or members; then the panel can be flexed outward from the wall to allow the upper edge to be placed into the upper edge fixing members; the panel can then be allowed to return to its normal shape, thus fitting securely into both the lower and upper edge fixing members. To use a side edge fixing member, the panel can be slid horizontally once held by the upper and lower edge fixing members until the panel is located in the side edge fixing member or members. If primary restraint members of a two-part interlocking mushroom head type as described above are to be used, both parts of the system can be attached to the rear face of the panel prior to attachment to the wall and then pressure can be applied to the front of the panel after fixing to cause an adhesive surface of the part of the primary restrain member which is to be attached to the wall to adhere to the wall. Alternatively, the wall-attached part of the system can be adhered to the wall prior to fitting of the panel.

In an alternative example, the panel can be attached to the wall by first fixing the lower edge fixing member to the wall, and then resting the lower edge of the panel in place in the lower edge fixing member. The panel can then be held upright against the wall, and any primary restraint members which are to be used can be affixed before the upper edge fixing member is located over the upper edge of the panel and subsequently attached to the wall.

In both example fixing methods, the panel can be handled simply by holding the panel at its edges, or by using releasable suction handles of the type used for handling glass. This allows the surface cladding system of the present example to be installed quickly with a minimum of health and safety issues with regard to the individuals carrying out the installation, and without any specialty tools.

Thus there has now been described a system for attaching a highly fire resistant, high strength panel to a wall. In order to extend the panelling system beyond single panels installed individually, additional fixing elements can be used to secure multiple panels together.

Figure 4A:
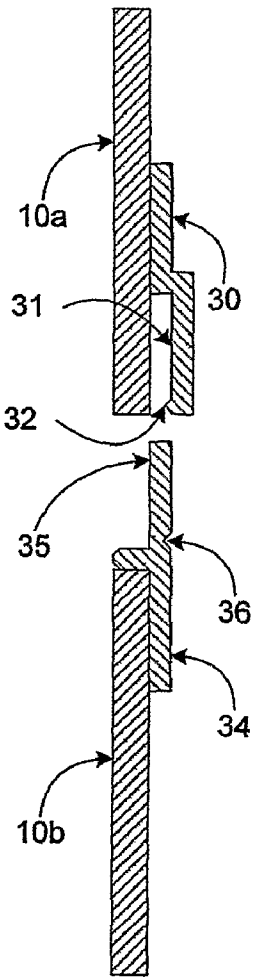

FIGS. 4*a* and 4*b* are a schematic sectional views through a part of a pair of panels 10*a* and 10*b*. The Figure shows a vertical view onto a plane running horizontally across the panel and normal to the panel and a wall on which the panel is mounted.

Two panels 10*a* and 10*b* of the present example can be joined together using a pair of co-operating panel joining members. As shown in FIG. 4*a*, The first panel 10*a* has affixed thereto a first panel joining member 30. The first panel joining member 30 has a portion 31 which extends away from the rear face of the panel to form a space between that part and the rear face. The first panel joining member also has a protrusion 32 thereon projecting into the space between the extending portion 31 and the rear face of the panel 10*a*. The panel joining member can be attached to the panel using an adhesive. Alternatively another fixing method such as a screw or bolt can be used.

The second panel 10*b* has affixed thereto a second panel joining member 34. The second panel joining member 34 has a portion 35 which extends beyond the side edge of the panel 10*b* and a recess 36 for receiving the protrusion 32 of the first panel joining member 30. The panel joining member can be attached to the panel using an adhesive. Alternatively another fixing method such as a screw or bolt can be used.

In order to secure the two panels together, the two panels are brought together to allow the first and second panel joining members to co-operate. The joined panels are shown in FIG. 4*b*, in position adjacent a wall. As can be seen in that Figure, the extending portion 35 of the second panel joining member 34 is inserted into the space formed between the extending part 31 of the first panel joining member 30 and the rear face of the panel 10*a*. Additionally, the protrusion 32 of the first panel joining member 30 is inserted into the recess 36 of the second panel joining member 34. The two panels are thereby securely yet releasably joined along a side edge. As shown in the figure, primary restraint members 22*a* and 22*b* can be used to hold the panels in position relative to the wall 12.

Thus the side edge of the panel 10 is restrained by the side edge fixing member 26 and is prevented thereby from moving horizontally in a direction through the side edge fixing member, away from the wall or toward the wall. Additionally, primary restraint members 22*a* and 22*b* are again be provided to hold the panel in position relative to the wall 12.

Thus there has now been described a system and method for applying high fire resistance wall panels to a wall, including a system and method for connecting panels together to form a run of interconnected panels, which can provide the effect of a single large panel attached to the wall.

Within many buildings, there can be corners between walls which require panelling. In order to provide a unified, tidy and hardwearing system, panels of the present example can be joined so as to provide a robust and smooth transition between walls.

Figure 5:
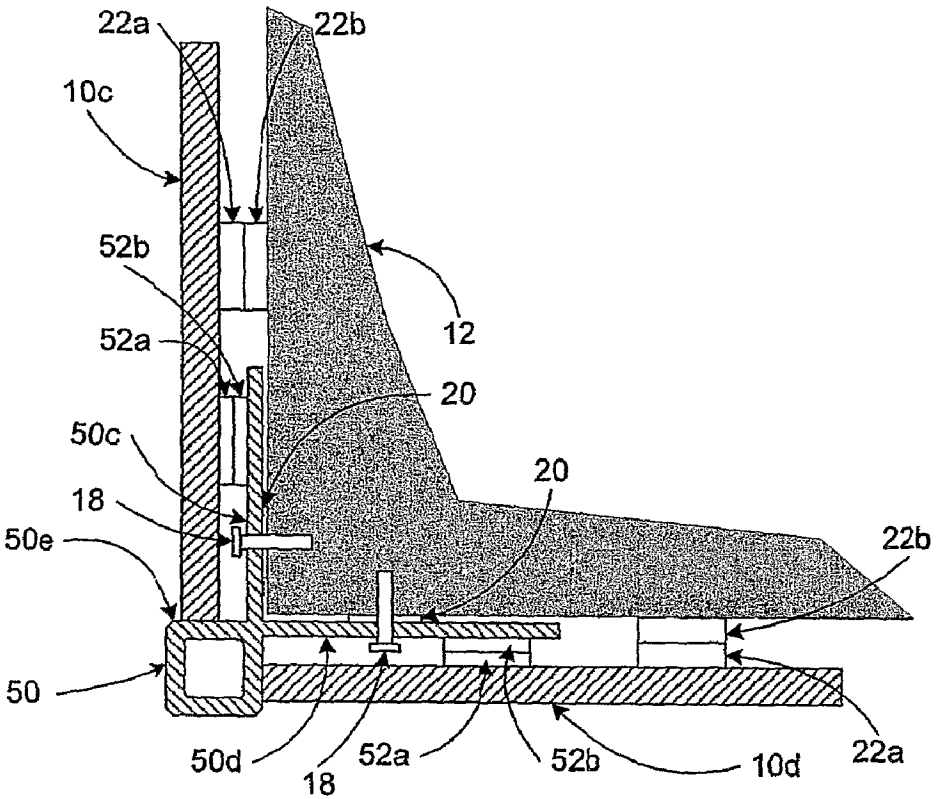
FIG. 5 is a schematic representation of another system for fixing two surface cladding panels together.

FIG. 5 is a schematic sectional view through a part of a pair of panels 10*c* and 10*d*. The Figure shows a vertical view onto a plane running horizontally across the panels and normal to the panels.

The panels 10*c* and 10*d* of the present example meet at angles to one another as shown in the Figure. As shown, each of the panels are attached to and spaced from the wall 12 by primary restraint members 22*a* and 22*b*. In order to bridge the gap between the panels and to protect the side edges of the panels and the corner of the wall behind, a corner joining member 50 can be used. The corner joining member 50 of the present example is a hollow post 50 having flange portions 50*c* and 50*d* which can extend behind the panels 10*c* and 10*d* respectively. A part of the post 50 can extend out between the panel side edges. The corner joining member can be secured to the wall 12 by a fixing element 18 such as a screw, bolt or nail. A spacer 20 may be provided to distance the corner joining member 50 from the wall 12. The fixing member 18 may be used in conjunction with an auxiliary fixing member (not shown) such as a captive nut or wall plug. The corner joining member 50 can be attached to the panels 10*c* and 10*d* by attachment members 52*a* and 52*b* fixed between the flange portions 50*c* and 50*d* and the rear faces of the panels 10*c* and 10*d* respectively. The attachment members 52*a* and 52*b* can be a thinner (lower profile) two-part interlocking mushroom head type fastening arrangement as used for the primary restraint members 22*a* and 22*b*.

Thus the side edges of the panels 10*c* and 10*d* and the corner of the wall 12 are protected by the corner joining member 50 restrained by the side edge fixing member 26 and the panels are held in position by the primary restraint members 22*a* and 22*b* as well as any upper, lower and side edge fixing members which may be used at other edges of the panels.

Thus there has now been described a complete system for releasably yet securely attaching a wall panels to a wall to clad the wall. The system can provide a fire-resistant and fire-safe environment for movement of persons and can resist attacks made by those persons both accidentally and deliberately.

Figure 6:
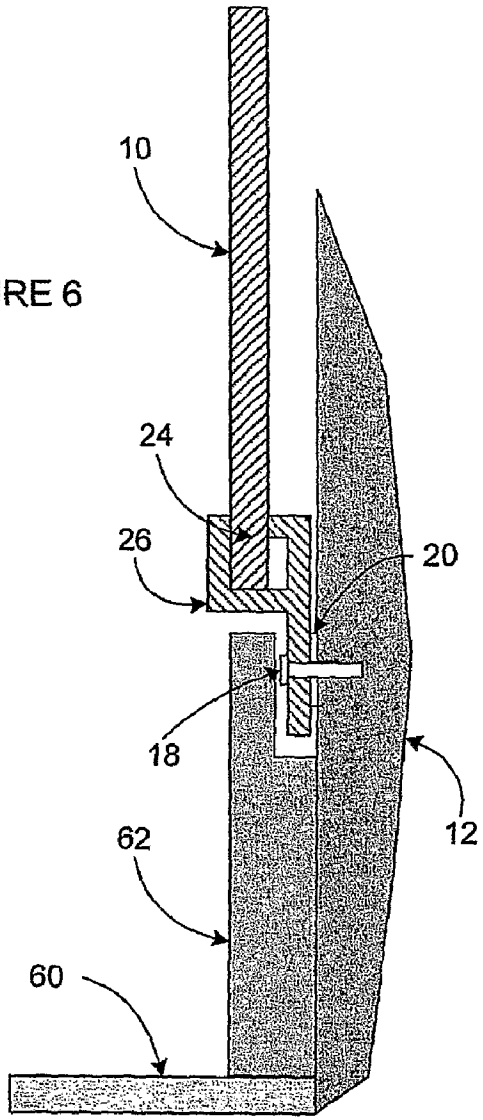
FIG. 6 is a schematic representation of another system for fixing a surface cladding panel to a wall at a bottom portion of the panel.

Referring now to FIG. 6, there will be described another example of a lower edge fixing member. FIG. 6 is a schematic sectional view through a part of a panel 10. The Figure shows a horizontal view onto a plane running vertically up the panel and normal to the panel and a wall on which the panel is mounted.

As in the example of FIG. 2, the panel 10 of the present example has a lower edge 24 which can be restrained by a lower edge fixing member 26. The lower fixing member can have a generally U-shaped portion for receiving at least a part of the lower edge of the panel 10 and a longitudinal portion for affixment to the wall 12. In some examples the U-shaped portion can be C-shaped or G-shaped. The lower edge fixing member 26 is attached to the wall 12 by a fixing element 18 such as a bolt, screw or nail. A spacer 20 may be provided to distance the lower edge fixing member 26 from the wall 12. The fixing member 18 may be used in conjunction with an auxiliary fixing member (not shown) such as a captive nut or a wall plug. To disguise a gap between the bottom of the panel and a floor 60, and to protect the lower edge fixing member 26 and the fixing element 18 from accidental or deliberate damage, a skirting board 62 can be fitted to the wall 12 between the floor 60 and the lower edge fixing member 26. The skirting board 62 can be profiled at its upper edge to hide the fixing member 18.

Thus the lower edge of the panel 10 is restrained by the lower edge fixing member 26 and is prevented thereby from moving downwards, away from the wall or toward the wall. Additionally, a protective skirting can protect the lower edge fixing member and the fixing means by which it is secured to the wall.

In the present example, the edge fixing members each run the entire length of the panel. This provides a secure fixing system making panel alignment during fitting quick and easy and protects the panel edges from accidental or deliberate damage. The primary restraint members can be provided in a number of arrangement patterns at the rear face of the panel. In some arrangements, long strips can used; and in other arrangements patches can be used.

There will now be described an alternative surface cladding system. The system of the present example uses a range of fixing elements to attach the cladding to a substrate material, usually a wall. The use of such fixing elements will now be described with reference to FIGS. 7 to 9.

Figure 7:
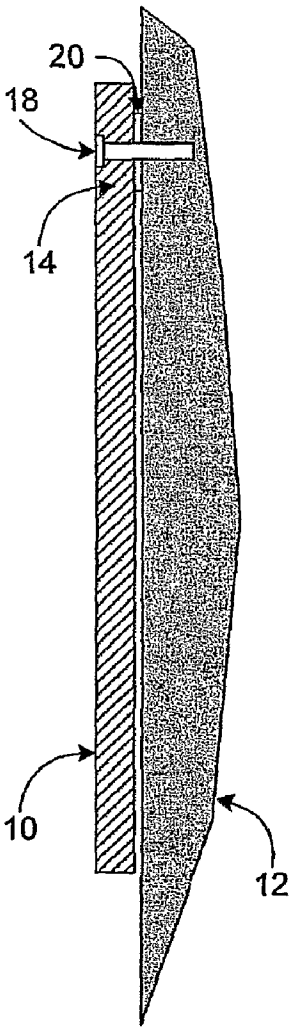
FIG. 7 is a schematic representation of another system for fixing a surface cladding panel to a wall at a top portion of the panel.

FIG. 7 is a schematic sectional view through a part of a panel 10. The Figure shows a horizontal view onto a plane running vertically up the panel and normal to the panel and a wall on which the panel is mounted.

The panel 10 is mounted onto a wall 12 and has an upper edge 14 which is restrained by a fixing element 18 such as a flush-faced recessed bolt, screw or nail. A spacer 20 may be provided to distance the panel 10 from the wall 12. The fixing element 18 may be used in conjunction with an auxiliary fixing member (not shown) such as a captive rail, captive nut or a wall plug.

Thus the upper edge of the panel 10 is restrained by the fixing element 18 and is prevented thereby from moving upwards, away from the wall or toward the wall. Additionally, restraint members (not shown) can be provided to hold the panel in position relative to the wall 12. In the present example, the restraint members are a two-part interlocking mushroom head type fastening, with one part being attached to the panel 10 and the other part being attached to the wall 10. The restraint members can be secured to the panel 10 and the wall 12 respectively using an adhesive. The use of the two-part interlocking head type primary restraint members provides dynamic loading and eliminate rattle between the panel and wall. Where the additional restraint members are provided, the fixing element 18 acts as secondary restraint members to secure the panel to the wall in the case of failure of the primary restraint members, for example in the case of fire melting the primary restraint members. The additional restraint members can be most effectively used where the panel size is large relative to the number of fixing elements 18 used to secure the panel.

Figure 8:
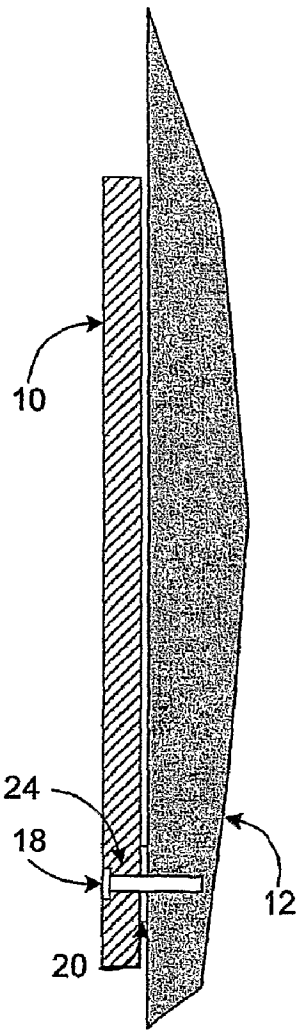
FIG. 8 is a schematic representation of another system for fixing a surface cladding panel to a wall at a bottom portion of the panel.

FIG. 8 is a schematic sectional view through a part of a panel 10. The Figure shows a horizontal view onto a plane running vertically up the panel and normal to the panel and a wall on which the panel is mounted.

The panel 10 of the present example has a lower edge 24 which can be restrained by a fixing element 18 such as a flush-faced recessed bolt, screw or nail. A spacer 20 may be provided to distance the panel 10 from the wall 12. The fixing element 18 may be used in conjunction with an auxiliary fixing member (not shown) such as a captive rail, captive nut or a wall plug.

Thus the lower edge of the panel 10 is restrained by the fixing element 18 and is prevented thereby from moving downwards, away from the wall or toward the wall. Additionally, additional restraint members (not shown) can again be provided to hold the panel in position relative to the wall 12.

Figure 9:
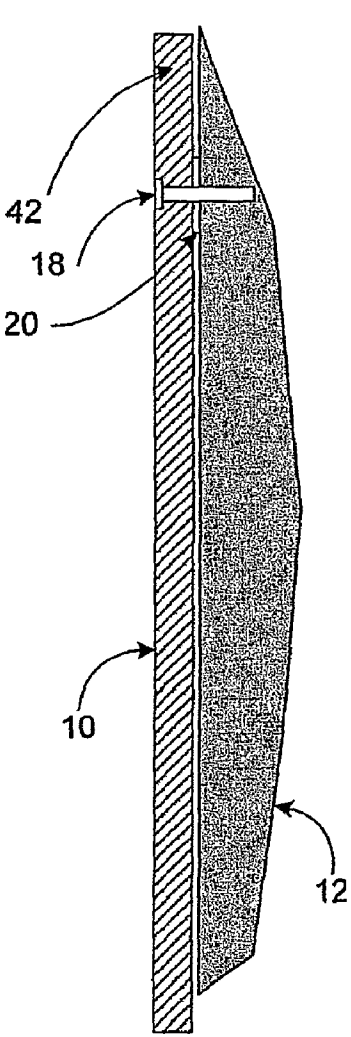
FIG. 9 is a schematic representation of another system for fixing a surface cladding panel to a wall at side portion of the panel.

FIG. 9 is a schematic sectional view through a part of a panel 10. The Figure shows a vertical view onto a plane running horizontally across the panel and normal to the panel and a wall on which the panel is mounted.

The panel 10 of the present example also has a side edge 42 which can be restrained by a fixing element 18 such as a flush-faced recessed bolt, screw or nail. A spacer 20 may be provided to distance the panel 42 from the wall 12. The fixing element 18 may be used in conjunction with an auxiliary fixing member (not shown) such as a captive rail, captive nut or a wall plug.

Thus the side edge of the panel 10 is restrained by the fixing element 18 and is prevented thereby from moving horizontally in a direction through the side edge fixing member, away from the wall or toward the wall. Additionally, additional restraint members (not shown) can be provided to hold the panel in position relative to the wall 12.

Thus there has now been described suitable fixing arrangements for securing a single panel to a wall. In the present example, the panel can be held in place against the wall and the fixing elements inserted into the wall. The panel can be held in place during this procedure by an individual taking part in the fitting process, or by the additional fixing elements.

The panel can be handled simply by holding the panel at its edges, or by using releasable suction handles of the type used for handling glass. This allows the surface cladding system of the present example to be installed quickly with a minimum of health and safety issues with regard to the individuals carrying out the installation, and without any specialty tools.

Thus there has now been described another example of a system for attaching a highly fire resistant, high strength panel to a surface.

Figure 11:
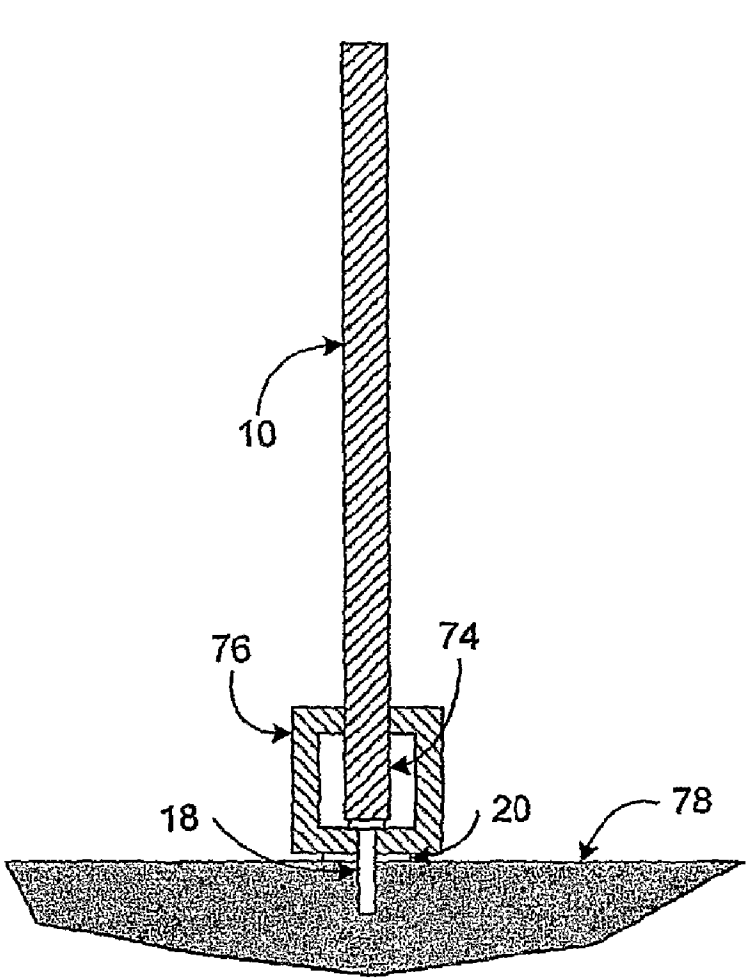
FIG. 11 is a schematic representation of a system for attaching a walling panel to a surface.
Figure 10B:
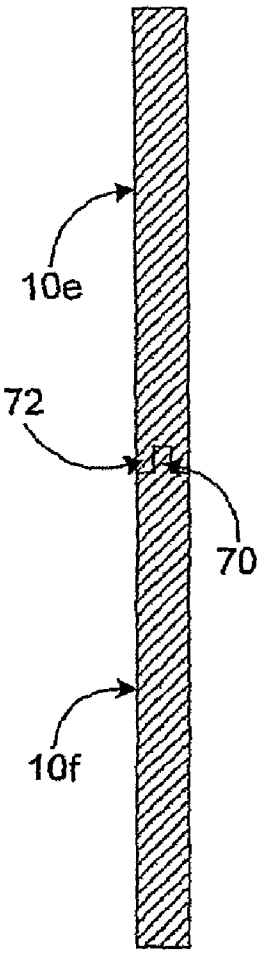
FIGS. 10*a* and 10*b* show a schematic representation of a system for fixing two walling panels together.
Figure 10A:
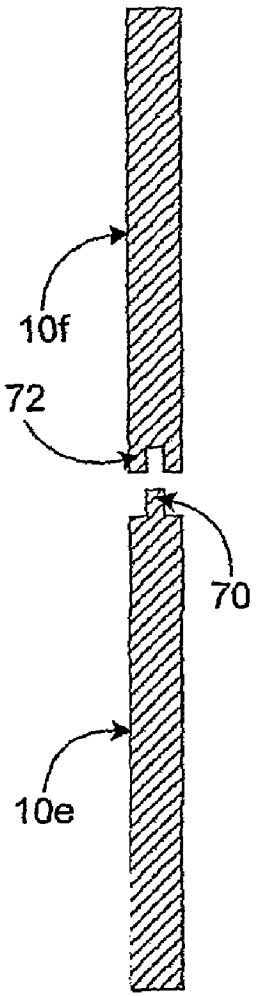

With reference to FIGS. 10*a*, 10*b* and 11, there will now be described an example of a walling system. In the present example, a plurality of panels can be used to create a wall, such as a partition wall to separate a corridor into two parallel, traffic isolated, corridors.

As shown in FIG. 10*a*, walling panels 10*e* and 10*f* can be provided with male and female connection members 70 and 72 respectively. The male and female connection members 70 and 72 can be configured to be co-operable to couple the panels 10*e* and 10*f* together by insertion of the male member 70 into the female member 72 as shown in FIG. 10*b*. The members can be configured to provide a releasable coupling between the panels 10*e* and 10*f*.

In the present example, the male and female members 70 and 72 are milled from square-edged panels. Thus the respective coupling members can be formed in such a fashion as to provide an unbroken surface of panel on both sides to increase tamper-resistance, and to provide a consistent performance of a wall formed from the walling panels in terms of fire resistance and heat resistance. By providing the coupling members by milling pre-formed panels, a joint which does not compromise the properties of the panel can be formed. Thus a wall comprising walling panels of the present example can have the same properties as an individual panel, in terms of meeting a regulatory requirement for panel properties.

In the present example, the thickness of the panels 10*e* and 10*f* is 25 mm. In other examples, the panels can be up to 100 mm or more thick.

With reference to FIG. 11, there will now be described a system for attaching a walling panel as used in the example of FIGS. 10*a* and 10*b* to a surface, such as a floor, ceiling or end-wall.

In the present example, a panel 10 is secured to a surface 78 by a walling panel securing member 76. The walling panel securing member 76 of the present example has a C-shape in cross section, although other examples could have, for example, a U-shape or a G-shape. The walling panel securing member 76 is configured to receive an edge part 74 of a panel 10 to hold that edge part 74 in position. Additional securing members (not shown) such as friction pads, resiliently biased friction pads or penetrative securing members (i.e. screws, bolts or nails which penetrate the panel) can be used to secure the edge part 74 within the walling panel securing member 76.

The walling panel securing member can be attached to the surface 78 by a fixing element 18, such as a bolt, screw or nail. A spacer 20 may be provided to distance the walling panel securing member 78 from the surface 78. The fixing member 18 may be used in conjunction with an auxiliary fixing member (not shown) such as a captive nut or a wall plug.

Thus there has now been described a system and method for providing a high performance, fire resistant partition wall to separate two areas of a pre-existing space into distinct and fire-isolated regions. This system and method can provide for flexible and easily movable partitioning of space whilst also providing a high level of fire safety to persons using the partitioned spaces.

Figure 12:
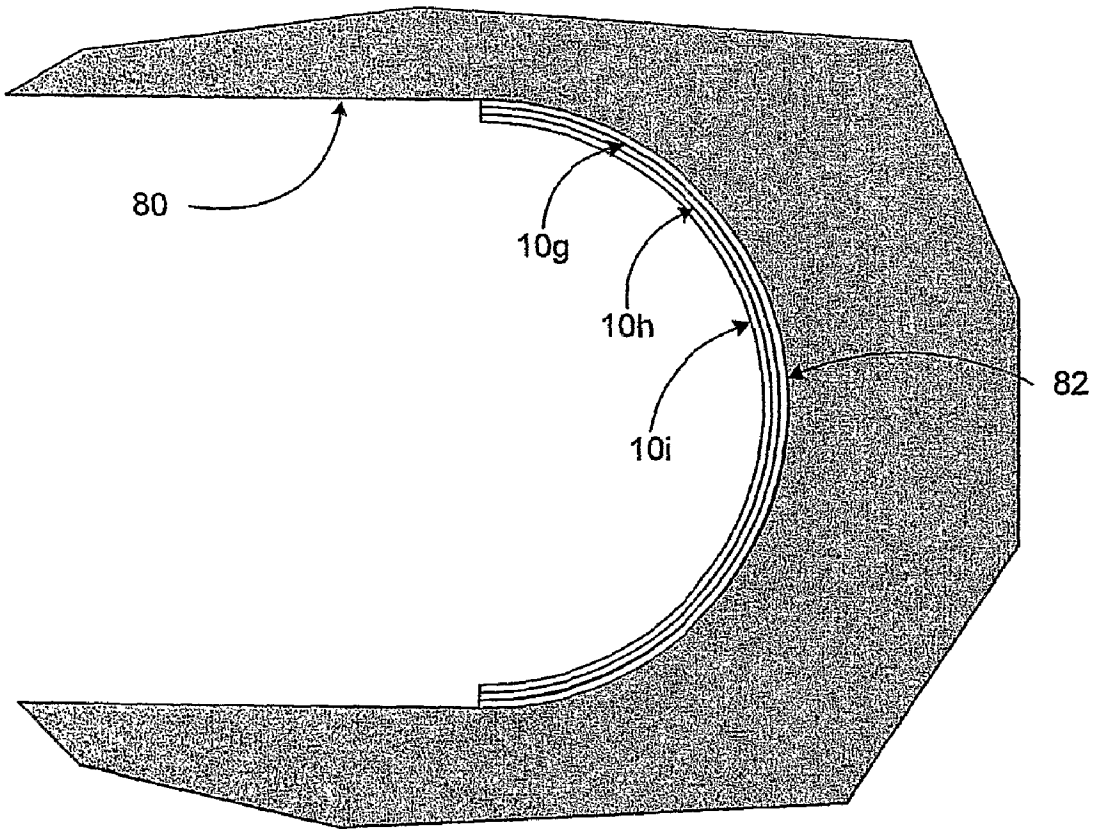
FIG. 12 is a schematic representation of a system for attaching a surface cladding panel to a curved surface.

With reference to FIG. 12, there will now be described a system and method for cladding a curved surface.

In the present example, a surface 80 has a curved portion 82. An example of curved surface which could require cladding is a tunnel.

Given the mechanical properties of materials of the type which can provide a high performance surface cladding system, the cladding of curved surfaces can present difficulties. This is because such materials may not be suitable for bending when formed into surface cladding panels such as those described with reference to FIGS. 1 to 9 above. In the examples of FIGS. 1 to 9, a typical surface cladding panel may be 5 mm thick, although both thinner and thicker panels can be used without compromising the properties of the panel. However, a 5 mm thick panel may be resistant to large degrees of bending and may fracture is excessive bending force is applied.

In the system of the present example, a curved surface 82 is clad with a plurality of thin panels 10*g*, 10*h* and 10*i*. The plurality of thin panels can be individually bent to fit the curved surface and then fixed together. In the present example the panels are bonded together in position using an adhesive. In other examples alternative fixing methods could be used. In the present example, three such thin panels are used. In another example, four thin panels, each having a thickness of 1.2 mm can be bonded together to form a composite panel of 4.8 mm total thickness.

In one example, a panel having a thickness of 1.2 mm can be bent to a limiting radius of curvature of 450 mm.

Thus there has now been described a system and method for cladding a curved surface to provide a high performance surface finish. Thus surfaces having curved portions can be clad, following the surface shape, to provide a low volume solution to provide a high safety environment.

Figure 13:
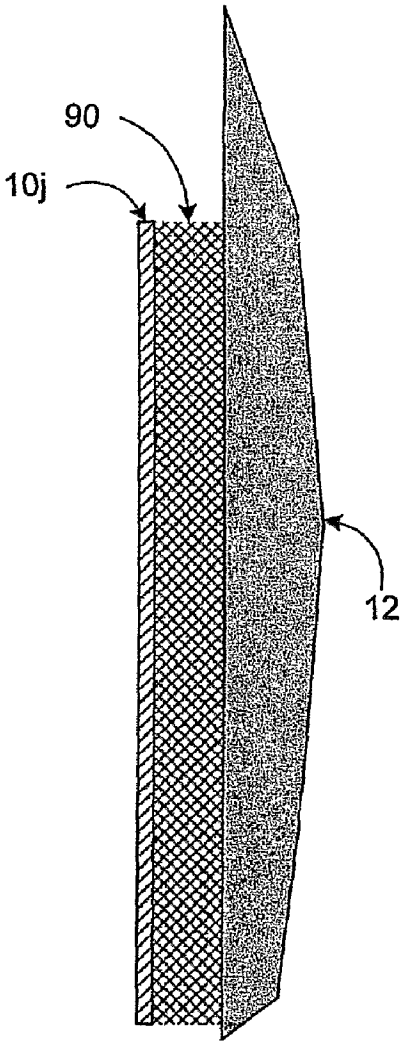
FIG. 13 is a schematic representation of a system for over-cladding an existing surface panelling installation.

With reference to FIG. 13, there will now be described a system and method for overcladding of an existing surface cladding arrangement to upgrade the properties of the surface cladding to meet a particular cladding performance requirement. Examples of situations where such system and method might be applied include an area being re-fitted for a new purpose (which attracts a higher performance requirement) or to meet a new performance requirement which has been applied to the area. Another example situation is where a surface cladding system has been installed in the belief that it meets a given performance requirement only to discover that the installed system does in fact not meet that requirement.

As shown in FIG. 13, a wall 12 is clad using a surface cladding arrangement 90. The surface cladding arrangement may be attached to the wall 12 using (not shown) adhesives, mechanical fasteners such as threaded fasteners or co-operable interlocking parts-type fasteners. To upgrade the performance and properties of the existing surface cladding arrangement 90, an overcladding panel 10*j* can be attached thereto. In the present example, the overcladding panel 10*j* can have a thickness of approximately 1.2 mm and can be attached to the existing surface cladding arrangement 90 using an adhesive. The adhesive can be pre-applied to the overcladding panel 10*j* to create a "peel-and-stick" type arrangement to facilitate quick and easy fixing of the overcladding panel. In other examples, other overcladding panel thicknesses and attachment methods can be used.

Thus there has now been described a system and method of overcladding an existing surface cladding arrangement to provide a higher performance cladding arrangement. Thereby, an existing cladding arrangement can be upgraded at low cost, with little or no waste material and with little effort or time required by persons carrying out the upgrade.

In the above described examples, the various panel joining and fixing members can be made from metal, such as steel, from a high strength, high impact resistance plastic, such as extruded polycarbonate, or from a composite, such as glass reinforced materials, such as preformed and machined variations of LSM21 and EM42.

As will be appreciated, many different shapes and formations of fixing members can be used to secure the panels to a surface whilst still satisfying the requirements of an easy and quick to fit panelling system suitable for use in Class 0 environments.

As will be appreciated, although the above surface cladding examples have been described in the context of cladding a wall, other surfaces can also be clad using a system of the invention, including ceilings, floors and roofs.

Although the embodiments above have been described in considerable detail, numerous variations and modifications will become apparent to those skilled in the art once the above disclosure is fully appreciated. It is intended that the following claims be interpreted to embrace all such variations and modifications as well as their equivalents.

What is claimed is:

1. A cladding system comprising: a panel for cladding a wall, the panel comprising a core of woven and non-woven glass impregnated with resin and a surface finish of paper, foil or other fire rated material and melamine resin; a first edge support member for supporting a first edge of the panel in position adjacent the wall; and a second edge support member for supporting a second edge of the panel in a position adjacent the wall; wherein the panel is configured to be supported by said first and second edge support members, wherein the first and the second edge support members are configured to directly provide coupling of the panel to the wall.

2. The cladding system of claim 1, wherein the panel is configured to be flexed to be fitted to pre-installed first and second edge support members.

3. The cladding system of claim 1, wherein the panel is configured to be fitted to a pre-installed first edge support member and wherein the second edge support member is configured to be installed following fitting of the panel to the first edge support member.

4. The cladding system of claim 1, wherein the panel comprises Micam LSM21 or Micam EM42.

5. The cladding system of claim 1, wherein the first edge support member has a cupping portion for receiving a first edge of the panel and an attachment portion for attachment to the wall.

6. The cladding system of claim 1, wherein the second edge support member has a cupping portion for receiving a second edge of the panel and an attachment portion for attachment to the wall.

7. The cladding system of claim 1, further comprising an attachment element configured to attach a non-edge portion of the panel to a wall.

8. The cladding system of claim 7, wherein the attachment element comprises a wall attached portion and a panel attached portion, the two portions being co-operable to attach the panel to the wall.

9. The cladding system of claim 8, wherein the attachment element comprises a two-part interlocking mushroom head type fastener.

10. The cladding system of claim 7, wherein the attachment element is configured to inhibit flexing of an installed panel.

11. The cladding system of claim 1, further comprising a second panel and a panel joining member for connecting the panels.

12. The cladding system of claim 11, wherein the panel joining member comprises first and second co-operable elements, one element being associated with each panel.

13. The cladding system of claim 11, wherein the panel joining member comprises first and second panel attachment portions interconnected by an angled portion, the panel joining member being configured to join non-parallel panels.

14. The cladding system of claim 1 for cladding a curved surface, wherein said panel is sufficiently flexible to bend to the curvature of the surface.

15. The cladding system of claim 14, comprising a plurality of said panels, each panel being sufficiently flexible to bend to the curvature of the surface, the panels being configured to be affixed to one-another to form a multi-layer composite panel.

16. The cladding system of claim 1, wherein first and the second edge support members are configured to directly provide coupling of the panel to the wall such that the panel and the wall are coupled in spaced apart relation.

17. A method of cladding a wall with panelling, the method comprising:

attaching a first panel support member to the wall, the first panel support member being configured to receive at least a part of a first edge of a panel comprising a core of woven and non-woven glass impregnated with resin and a surface finish of paper and melamine resin;

placing the first edge in a position of co-operative reception with the first panel support member; and placing a second edge of the panel substantially opposite the first edge in a position of co-operative reception with a second panel support member, the second panel support member being configured to be attached to the wall.

18. The method claim 17, wherein the second panel support member is attached to the wall prior to the placing of the second edge in a position of co-operative reception therewith, the method further comprising:

following placing the first edge in the position of co-operative reception with the first panel support member, flexing the panel to enable the second edge to be placed in a position of co-operative reception with the second panel support member; and de-flexing the panel such that the panel is supported by the first and second support members.

19. The method of claim 17, wherein the second support member is attached to the wall after the placing of the second edge in a position of co-operative reception therewith.

20. The method of claim 17, using a tertiary support member to releasably secure the panel into position after fitting.

21. The method of claim 20, wherein the tertiary support member comprises first and second co-operable elements, the method further comprising:

attaching the first element to the wall;

attaching the second element to the panel; and applying pressure to the panel to cause co-operation between the elements after de-flexing the panel.

22. The method of claim 17, wherein the panel comprises Micam LSM21 or Micam EM42.

23. The method of claim 17, further comprising joining a further panel using a panel joining member.

24. The method of claim 23 wherein the panel joining member comprises first and second co-operable elements, one element being associated with each panel, the method comprising placing the panels in alignment and causing co-operable portions of the first and second elements to interact to releasably secure the panels together.

25. The method of claim 23, wherein the panel joining member comprises first and second panel attachment portions and a connection portion, wherein the method further comprises, attaching the panel joining member to a first panel;

attaching the second panel to a second wall not-parallel to the first wall and attaching the second panel to the panel joining member.

26. The method of claim 18, for cladding a curved surface, the method further comprising flexing the panel to bend to the curvature of the surface.

27. The method of claim 26, comprising affixing a plurality of said panels to one-another in said flexed configuration to form a multi-layer composite panel.

28. The method claim 17, wherein in the placing steps, the first and the second panel support members are configured to directly provide coupling of the panel to the wall such that the panel and the wall are coupled in spaced apart relation.

* * * * *